US012690646B1

(12) United States Patent
Greene et al.

(10) Patent No.: US 12,690,646 B1
(45) Date of Patent: Jul. 28, 2026

(54) SHOE DECORATION KIT

(71) Applicants: James Greene, Glendale, AZ (US); Colby Greene, Glendale, AZ (US)

(72) Inventors: James Greene, Glendale, AZ (US); Colby Greene, Glendale, AZ (US)

( * ) Notice: Subject to any disclaimer, the term of this patent is extended or adjusted under 35 U.S.C. 154(b) by 0 days.

(21) Appl. No.: 19/251,050

(22) Filed: Jun. 26, 2025

(51) Int. Cl.

| | |
|---|---|
| ***A43B 23/24*** | (2006.01) |
| ***A43C 19/00*** | (2006.01) |
| ***A63H 33/08*** | (2006.01) |
| *A43B 3/00* | (2022.01) |

(52) U.S. Cl.
CPC ..... *A43C 19/00* (2013.01); *A63H 33/086* (2013.01); *A43B 3/0078* (2013.01); *A43B 23/24* (2013.01)

(58) Field of Classification Search
CPC ..... A43B 23/24; A43B 3/0078; A43C 19/00
See application file for complete search history.

(56) References Cited

U.S. PATENT DOCUMENTS

| | | | | |
|---|---|---|---|---|
| 3,005,282 | A | 10/1961 | Christiansen | |
| 4,606,732 | A * | 8/1986 | Lyman | A63H 33/042 446/104 |
| 4,712,319 | A * | 12/1987 | Goria | A43B 1/0036 359/518 |
| 4,789,369 | A * | 12/1988 | Lyman | A63H 33/042 446/104 |
| 4,958,459 | A | 9/1990 | Davidson | |
| 4,991,273 | A | 2/1991 | Huttle | |
| 5,136,726 | A * | 8/1992 | Kellin | A43B 23/24 2/310 |
| 5,673,501 | A * | 10/1997 | Mathews | A43B 3/0078 36/112 |
| 7,987,617 | B2 | 8/2011 | Kohatsu | |
| 8,540,544 | B1 * | 9/2013 | Logue | A43B 3/105 446/101 |
| 8,925,116 | B2 | 1/2015 | Augustine | |
| 9,480,931 | B1 * | 11/2016 | Samo | A63H 33/065 |
| D878,032 | S | 3/2020 | Rosenbaum | |
| D1,060,521 | S | 2/2025 | Cai | |
| 2002/0116851 | A1 * | 8/2002 | Ferguson | G09F 3/207 40/636 |
| 2005/0126041 | A1 * | 6/2005 | Gonzalez Palacio | A43C 11/06 36/50.1 |

(Continued)

FOREIGN PATENT DOCUMENTS

| | | | | |
|---|---|---|---|---|
| KR | 20230149965 A | * 10/2023 | | A41D 27/08 |
| WO | WO2011065964 | 6/2011 | | |

*Primary Examiner* — Katharine G Kane

(57) ABSTRACT

A shoe decoration kit includes a plurality of mini-bricks and a plurality of mini-brick accessories. Each of the mini-bricks includes a plurality of projections and a receptacle portion designed to detachably couple the mini-bricks with other mini-bricks and mini-brick accessories. The mini-brick block includes a block passage that has a pair of apertures in a perimeter block wall designed for insertion of a shoelace into and through the mini-brick block parallel to a top block wall to removably secure the mini-brick block to a shoe. The mini-brick panel has a pair of apertures for similar connection to the shoelace. Each of the mini-brick accessories is designed to detachably couple to the mini-bricks and other mini-brick accessories. The mini-brick accessories include tiles, bulbs, chains, plates, and a figurine in the form of a person.

16 Claims, 8 Drawing Sheets

(56) References Cited

U.S. PATENT DOCUMENTS

| | | | | |
|---|---|---|---|---|
| 2005/0188565 | A1* | 9/2005 | Tobias | A43C 11/24 36/112 |
| 2008/0060110 | A1* | 3/2008 | Schmelzer | A44B 1/32 2/69 |
| 2008/0086917 | A1* | 4/2008 | Carrillo | A43B 3/0078 36/136 |
| 2008/0141560 | A1* | 6/2008 | Lewis | A43B 3/0078 36/50.1 |
| 2009/0091921 | A1* | 4/2009 | Yang | A43B 23/24 362/103 |
| 2009/0205175 | A1* | 8/2009 | Han | A43C 11/22 24/712.1 |
| 2015/0052713 | A1 | 2/2015 | Hannan | |
| 2015/0272279 | A1* | 10/2015 | Toffanello | A44C 3/001 24/453 |
| 2016/0235163 | A1* | 8/2016 | Alander | A43B 21/433 |
| 2017/0245596 | A1* | 8/2017 | Woodward | A43C 11/1493 |
| 2017/0325527 | A1* | 11/2017 | Lewis | G09F 3/207 |
| 2019/0059518 | A1 | 2/2019 | Phillips | |
| 2021/0330039 | A1* | 10/2021 | Cureton | A43C 19/00 |
| 2022/0087367 | A1 | 3/2022 | Kothari | |
| 2024/0138522 | A1* | 5/2024 | Filus | A43C 7/00 |
| 2024/0237784 | A1* | 7/2024 | Greene | A43B 3/0078 |
| 2024/0381979 | A1* | 11/2024 | Singleton | A43B 23/24 |

* cited by examiner

SHOE DECORATION KIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to decorations for shoes and more particularly pertains to a new shoe decoration kit for decorating shoes with mini-bricks. Shoe decorations, such as beads and clips, are well known for attachment to shoelaces to provide a different or fun aesthetic. The new shoe decoration kit includes mini-bricks and mini-brick accessories to provide a way to decorate shoes that is both visually pleasing and mentally and physically engaging as the wearer can manipulate the mini-bricks and mini-brick accessories to form customized decorations on the shoes and separate toys and useful devices when removed from the shoes. It should be noted that the phrases "mini-brick" or "mini-bricks" as used in this application refer to any type of miniature toy bricks or miniature decorative bricks.

(2) Description of Related Art Including Information Disclosed Under 37 CFR 1.97 and 1.98

The prior art relates to decorations for shoes. The prior art, as best understood, does not disclose a shoe decoration kit that includes a plurality of mini-bricks and a plurality of mini-brick accessories, wherein a mini-brick block includes a block passage that has a pair of apertures in the perimeter block wall designed for insertion of a shoelace into and through the mini-brick block parallel to the top block wall to removably secure the mini-brick block to a shoe, and a mini-brick panel has a pair of apertures designed for insertion of a shoelace through opposing ends of the mini-brick panel to removably secure the mini-brick panel to the shoe, and each of the mini-brick accessories includes a receptacle portion designed to detachably couple the mini-brick accessories to the projections of the mini-bricks and other mini-brick accessories to removably secure the mini-brick accessories to the shoe.

BRIEF SUMMARY OF THE INVENTION

An embodiment of the disclosure meets the needs presented above in a shoe decoration kit generally comprising a plurality of mini-bricks and a plurality of mini-brick accessories. Each of the mini-bricks includes a plurality of projections designed to detachably couple the mini-bricks to receptacle portions of other mini-bricks and mini-brick accessories. Each of the mini-bricks includes a receptacle portion designed to detachably couple the mini-bricks to projections of other mini-bricks and mini-brick accessories. The mini-bricks include at least one mini-brick block and at least one mini-brick panel. The mini-brick block includes a top block wall and a perimeter block wall extending perpendicularly from the top block wall. The mini-brick block includes a block passage that has a pair of apertures in the perimeter block wall designed for insertion of a shoelace into and through the mini-brick block parallel to the top block wall to removably secure the mini-brick block to a shoe. The mini-brick panel has a pair of apertures designed for insertion of a shoelace through opposing ends of the mini-brick panel to removably secure the mini-brick panel to the shoe. Each of the mini-brick accessories includes a receptacle portion designed to detachably couple the mini-brick accessories to the projections of the mini-bricks and other mini-brick accessories to removably secure the mini-brick accessories to the shoe. The mini-brick accessories include at least one of: tiles, bulbs, chains, plates, and a figurine in the form of a person.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
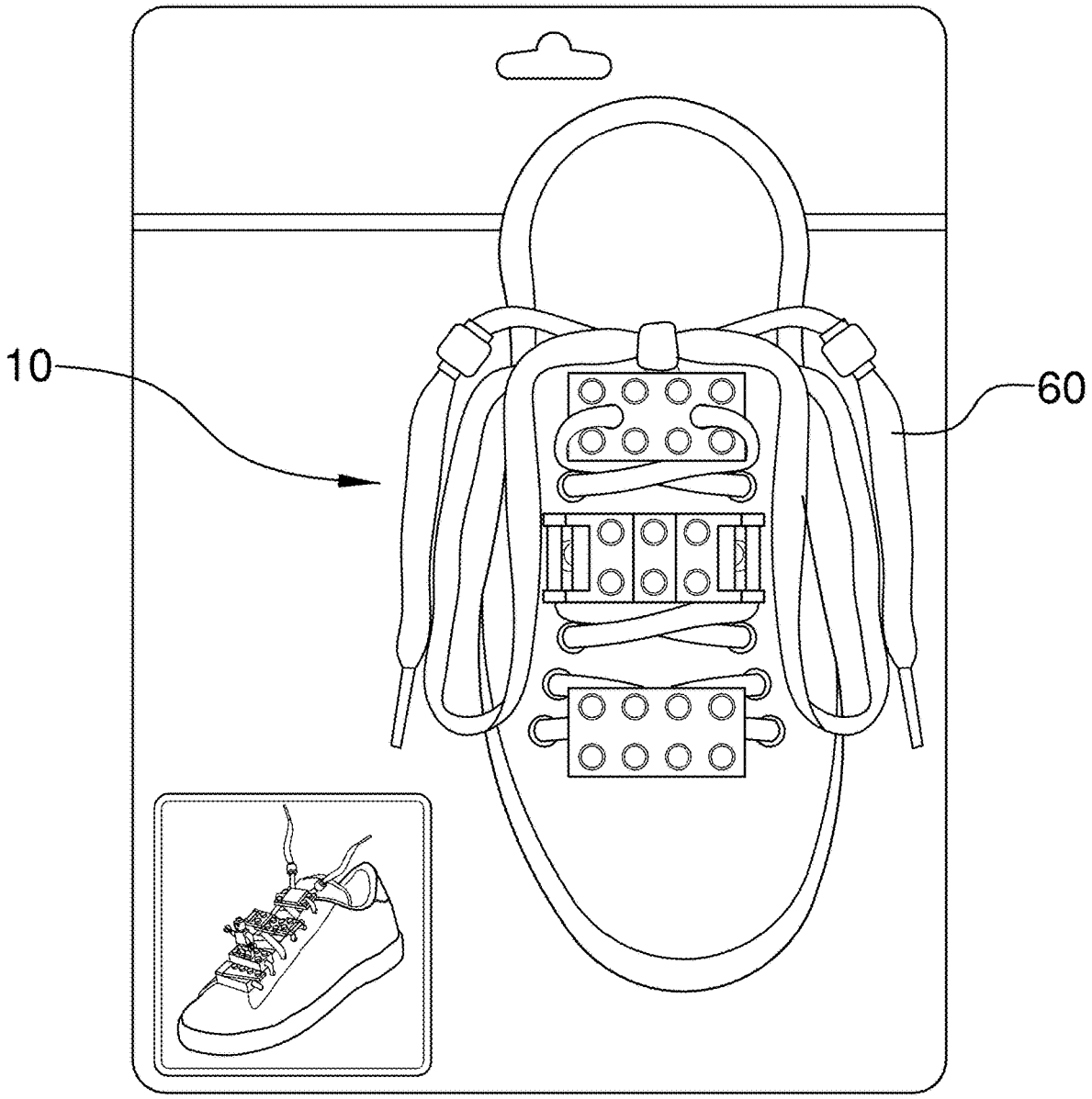
FIG. 1 is a front view of a shoe decoration kit according to an embodiment of the disclosure.

With reference now to the drawings, and in particular to FIGS. 1 through 8 thereof, a new shoe decoration kit embodying the principles and concepts of an embodiment of the disclosure and generally designated by the reference numeral 10 will be described.

Figure 2:
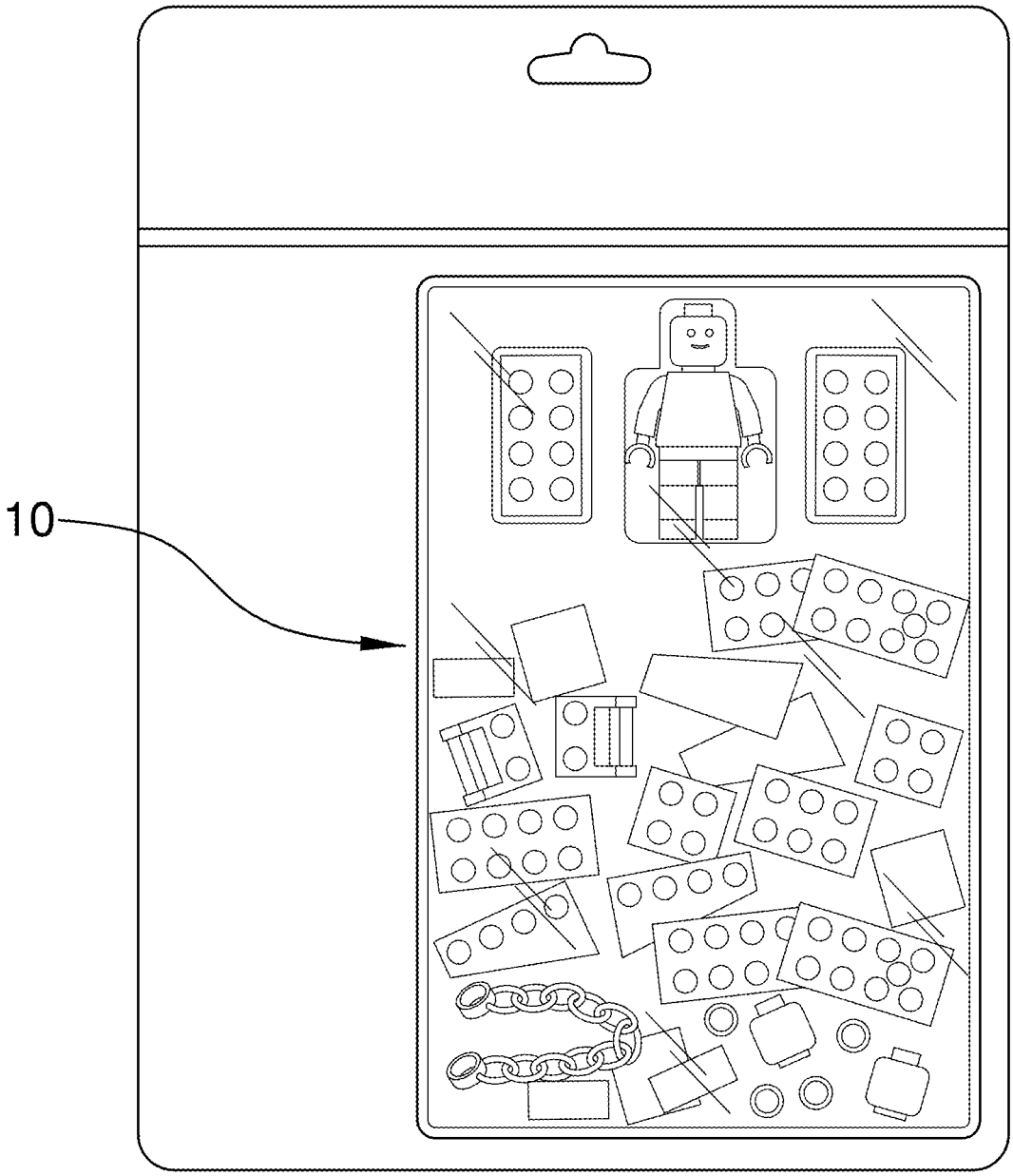
FIG. 2 is a rear view of an embodiment of the disclosure.
Figure 3:
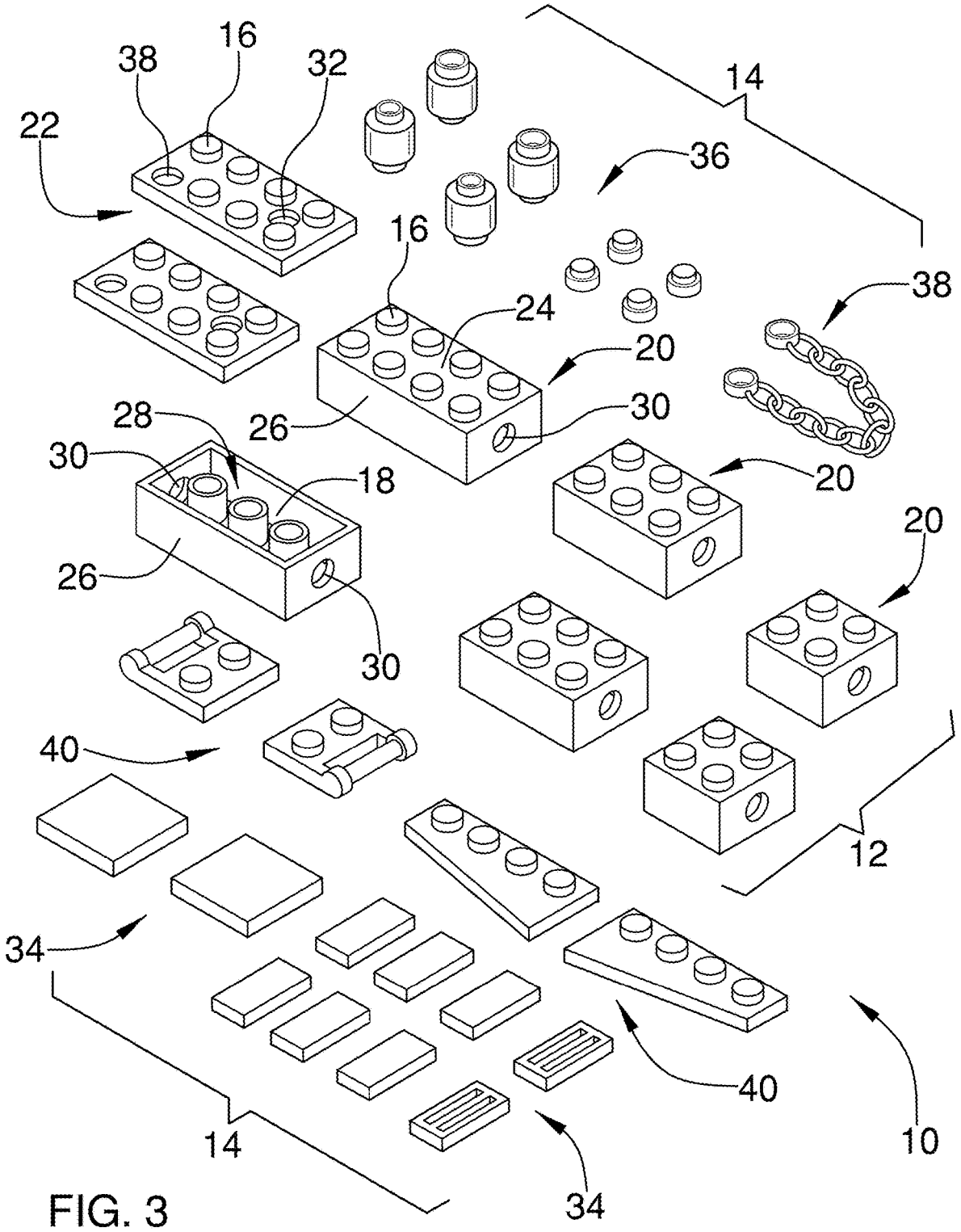
FIG. 3 is a perspective view of an embodiment of the disclosure.

As best illustrated in FIGS. 1 through 8, the shoe decoration kit 10 generally comprises a plurality of mini-bricks 12 and a plurality of mini-brick accessories 14, as best seen in FIG. 3. Each of the mini-bricks 12 includes a plurality of projections 16 designed to detachably couple the mini-bricks 12 to receptacle portions 18 of other mini-bricks 12 and mini-brick accessories 14. Each of the mini-bricks 12 includes a receptacle portion 18 designed to detachably couple the mini-bricks 12 to projections 16 of other mini-bricks 12 and mini-brick accessories 14.

The mini-bricks 12 include at least one mini-brick block 20 and at least one mini-brick panel 22. The mini-brick block 20 includes a top block wall 24 and a perimeter block wall 26 extending perpendicularly from the top block wall 24. The mini-brick block 20 includes a block passage 28 that has a pair of apertures 30 in the perimeter block wall 26 designed for insertion of a shoelace 60 into and through the mini-brick block 20 parallel to the top block wall 24 to removably secure the mini-brick block 20 to a shoe 62.

The mini-brick panel 22 has a pair of apertures 32 designed for insertion of a shoelace 60 through opposing ends of the mini-brick panel 22 to removably secure the mini-brick panel 22 to the shoe 62. Each of the mini-brick accessories 14 includes a receptacle portion 18 designed to detachably couple the mini-brick accessories 14 to the projections 16 of the mini-bricks 12 and other mini-brick accessories 14 to removably secure the mini-brick accessories 14 to the shoe 62.

The mini-brick accessories 14 include at least one of: tiles 34, bulbs 36, chains 38, plates 40, and a figurine 42 in the form of a person.

In the exemplary embodiment in FIGS. 1 and 2, the shoe decoration kit 10 further includes a shoelace 60, or possibly a pair of shoelaces 60. The shoelaces 60, the mini-bricks 12, and the mini-brick accessories 14 can be packaged and sold as a single unit as shown. However, in another possible embodiment, the shoelaces 60 could be omitted and only the mini-bricks 12 and the mini-brick accessories 14 sold together as the shoe decoration kit 10.

The apertures 32 in the mini-brick panels 22 are formed either in between the projections 16 or in place of one of the projections 16. In the exemplary embodiment in FIG. 3, the apertures 32 are located one between the projections 16 and one in place of one of the projections 16. The apertures 30 in the mini-brick blocks 20 are at opposing ends of the perimeter block wall 26. However, they could be located in the top wall 24 or possibly in adjoining sections of the perimeter block wall 26.

FIG. 3 shows the various components that could be included in one possible embodiment of the shoe decoration kit 10, though more or fewer components of varying number and design could be included in other possible embodiments, which are not limited by the exemplary embodiments in the figures. In the exemplary embodiment in FIG. 3, the mini-brick accessories 14 include the figurine 42 in the form of a person, the chain 38 to secure the figurine 42 to one of the mini-bricks 12 or one of the mini-brick accessories 14, the tiles 34, the bulbs 36, and the plates 40.

Figure 4:
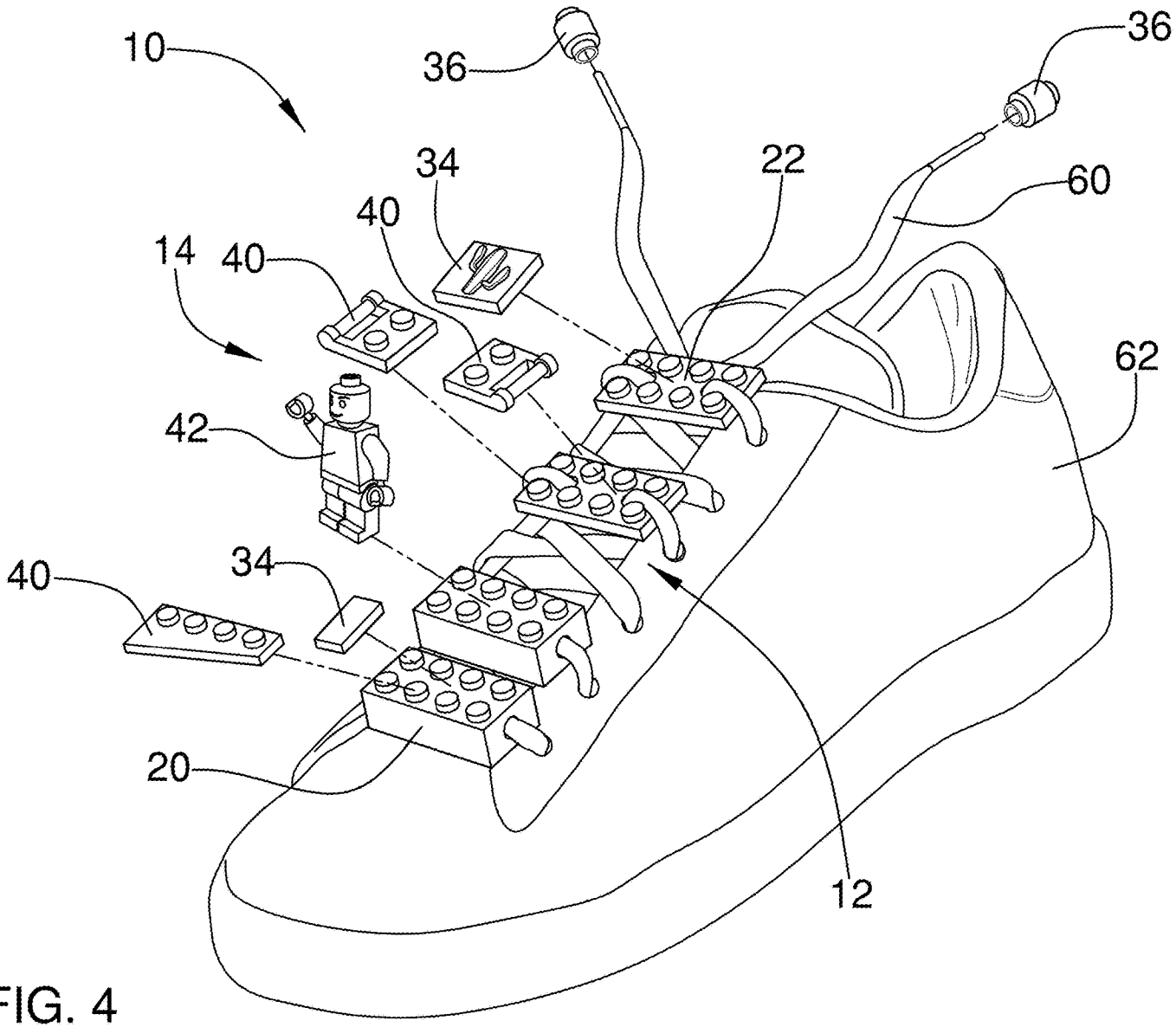
FIG. 4 is a perspective view of an embodiment of the disclosure in use.
Figure 7:
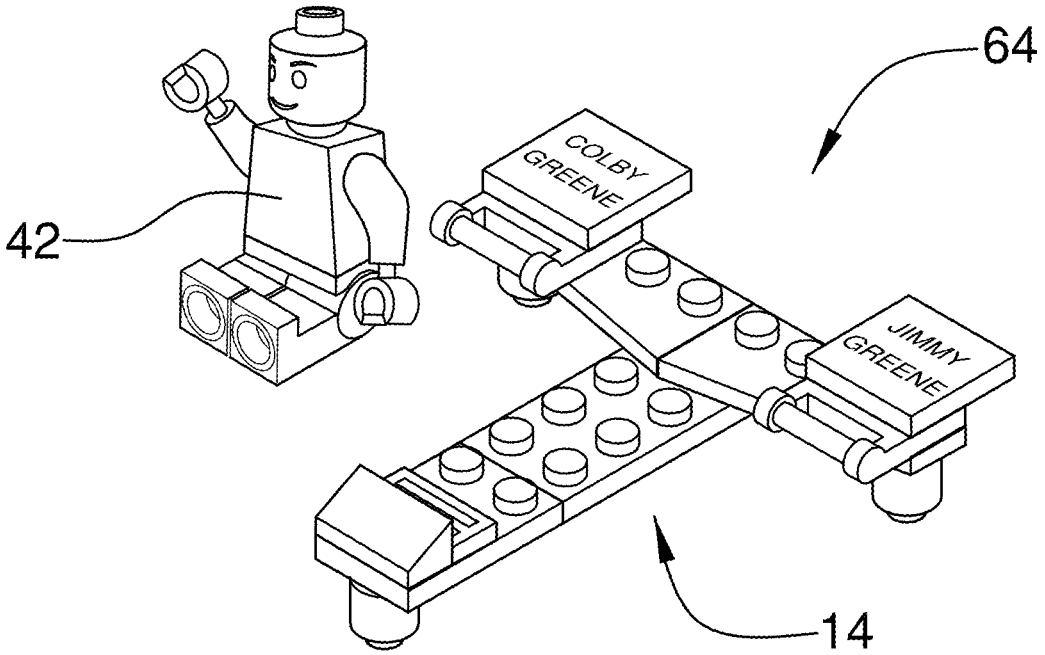
FIG. 7 is a perspective view of an embodiment of the disclosure in use.

The tiles 34 can be designed to include a decorative image, such as the cactus in FIG. 4 or the names in FIG. 7. The bulbs 36 are hollow for threading the bulbs 36 onto the shoelace 60 or placement on one of the projections 16 of the mini-bricks 12. The plates 40 are at least one of square, circular, rectangular, triangular, and trapezoidal in shape, though only square and rectangular plates 40 are shown in FIG. 3.

It should be noted that the mini-bricks 12 and mini-brick accessories 14 shown in the figures are only exemplary embodiments as the sizes, shapes, and types could vary as desired to produce different aesthetic and practical effects. Virtually any type of mini-brick 12 or mini-brick accessory 14 could be used. In addition, virtually any color or design can be included on the mini-bricks 12 or mini-brick accessories 14, such as images, pictures, logos, and other decorative imagery. In one possible embodiment, the shoe decoration kit 10 could include decals or stickers, which could follow a theme, such as a sports team or a fictional work or movie.

Figure 6:
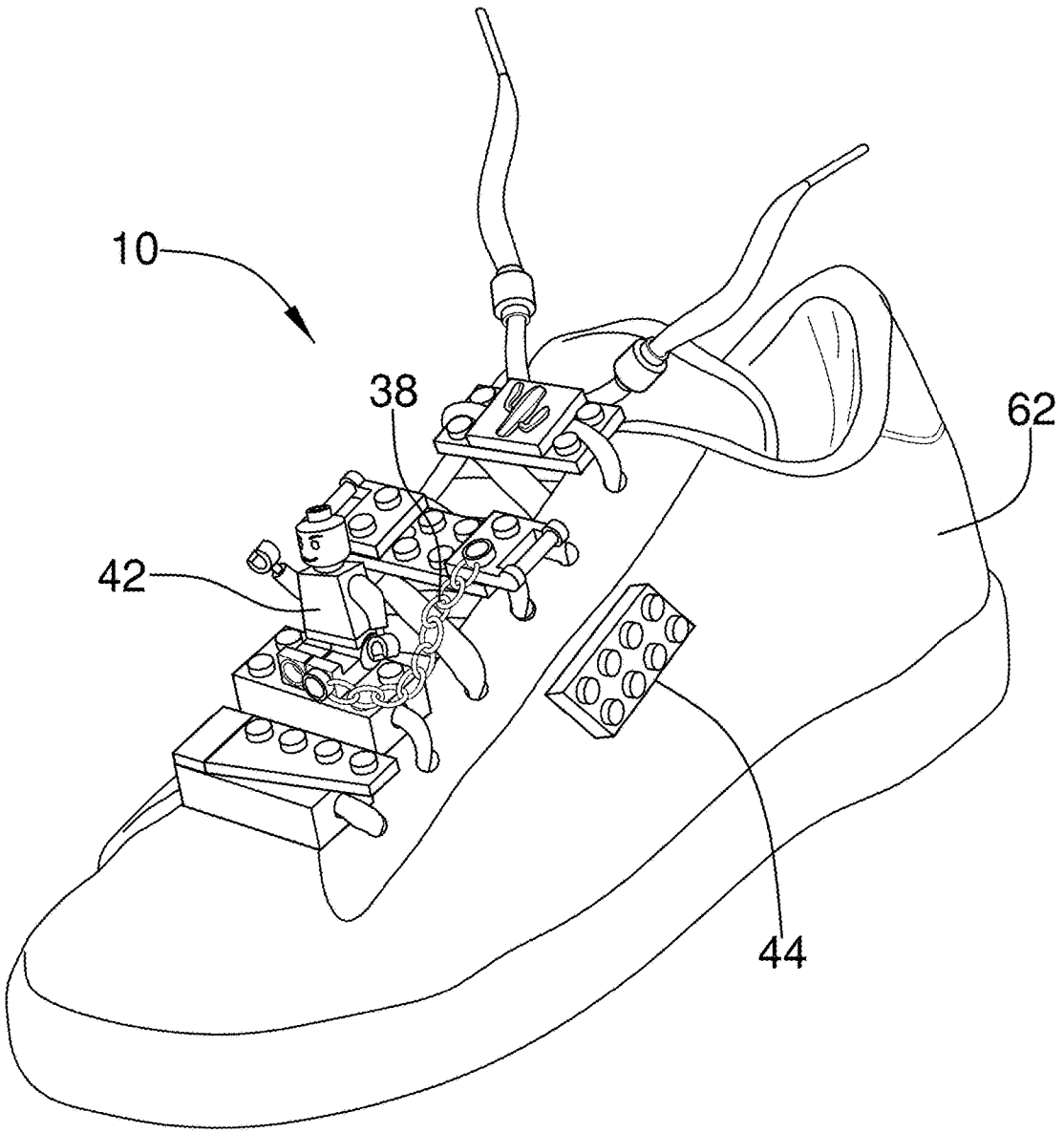
FIG. 6 is a perspective view of an embodiment of the disclosure in use.

In the exemplary embodiment in FIG. 6, the mini-bricks 12 further include at least one complete mini-brick 44 without apertures 30 therein. The complete mini-brick 44 includes adhesive to adhere the complete mini-brick 44 to at least one of: the shoelace 60 and the shoe 62. Such adhesive is one way to permanently or semi-permanently adhere the complete mini-brick 44 to any location on the shoe 62, as shown in FIG. 6, as opposed to the friction fit when the projections 16 engage with the receptacle portions 18.

In addition, in one possible embodiment, the mini-bricks 12 and mini-brick accessories 14 could also have the adhesive or other connection means for permanent or semi-permanent connections, such as clasps, snap fits, magnets, and other types of connectors to further secure mini-bricks 12 and mini-brick accessories 14 together and minimize accidental or inadvertent detachment from the shoe 62 or one another.

Figure 5:
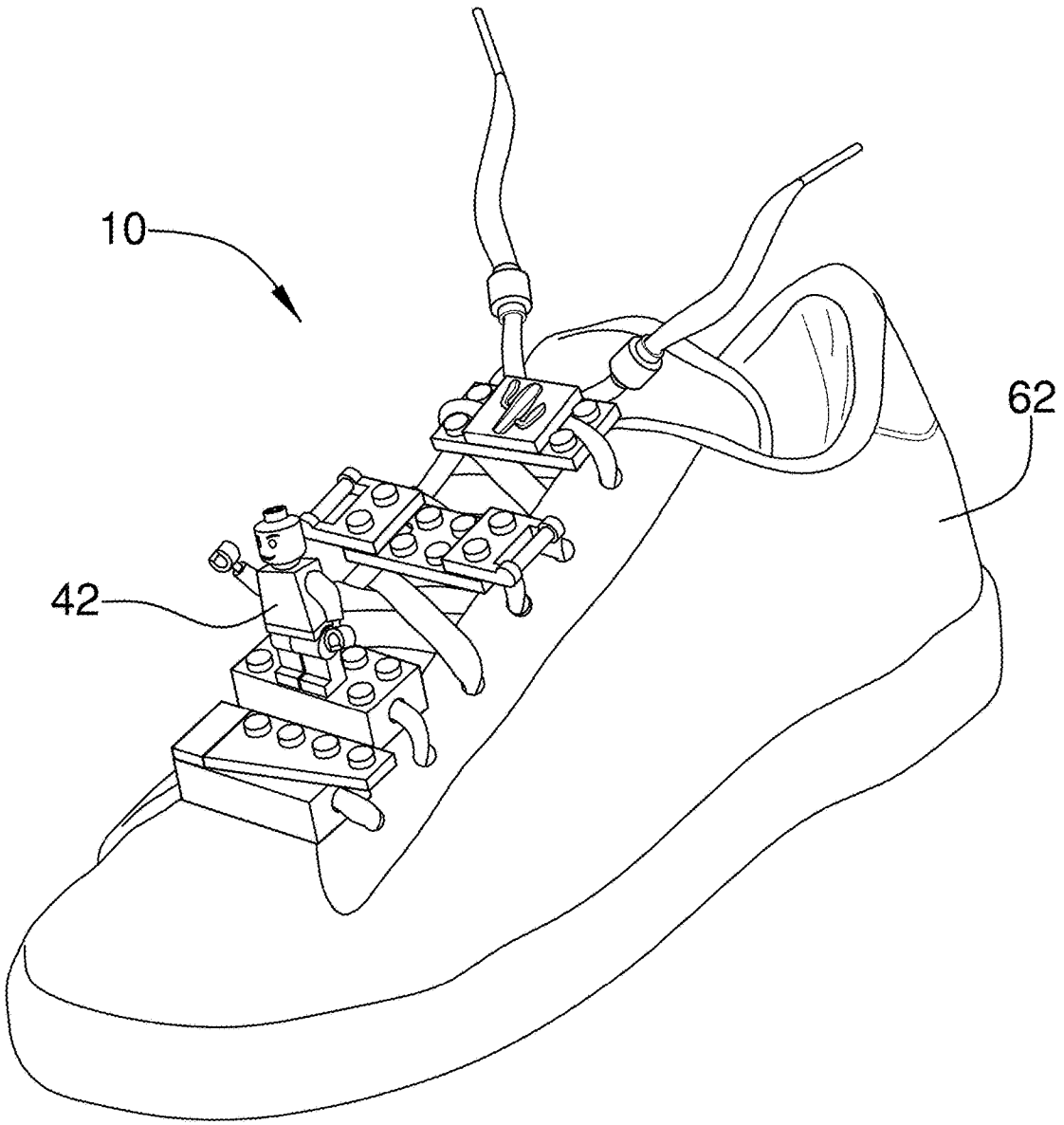
FIG. 5 is a perspective view of an embodiment of the disclosure in use.

FIGS. 4, 5, and 6 show how the shoe decoration kit 10 is assembled on the shoe 62. The shoelace 60 is first woven through the mini-brick blocks 20 and mini-brick panels 22 to secure them in place on the shoe 62. The mini-brick accessories 14 are then detachably coupled to the mini-bricks 12. FIGS. 5 and 6 show how customization can be done, such as having the figurine 42 in a standing position or seated with the chain 38 connected. FIG. 6 also shows the complete mini-brick 44 adhered to the side of the shoe 62. The customization options are virtually endless depending on the components of the shoe decoration kit 10.

In one possible embodiment, the mini-brick accessories 14 are designed to be assembled into a toy or functional device, also known as a mini-build, after detachment from the mini-bricks 12. For example, the mini-brick accessories 14 could be designed to form an airplane or glider 64 type device, as shown in FIG. 7, that the figurine 42 could be seated on. In the exemplary embodiment in FIG. 8, the mini-brick accessories 14 are designed to form a cell phone stand 66 to hold a cell phone 68, such as for viewing movies or videos. A user can therefore decorate the shoe 62 but also use the mini-brick accessories 14 for a practical purpose rather than simply as a decoration.

Figure 8:
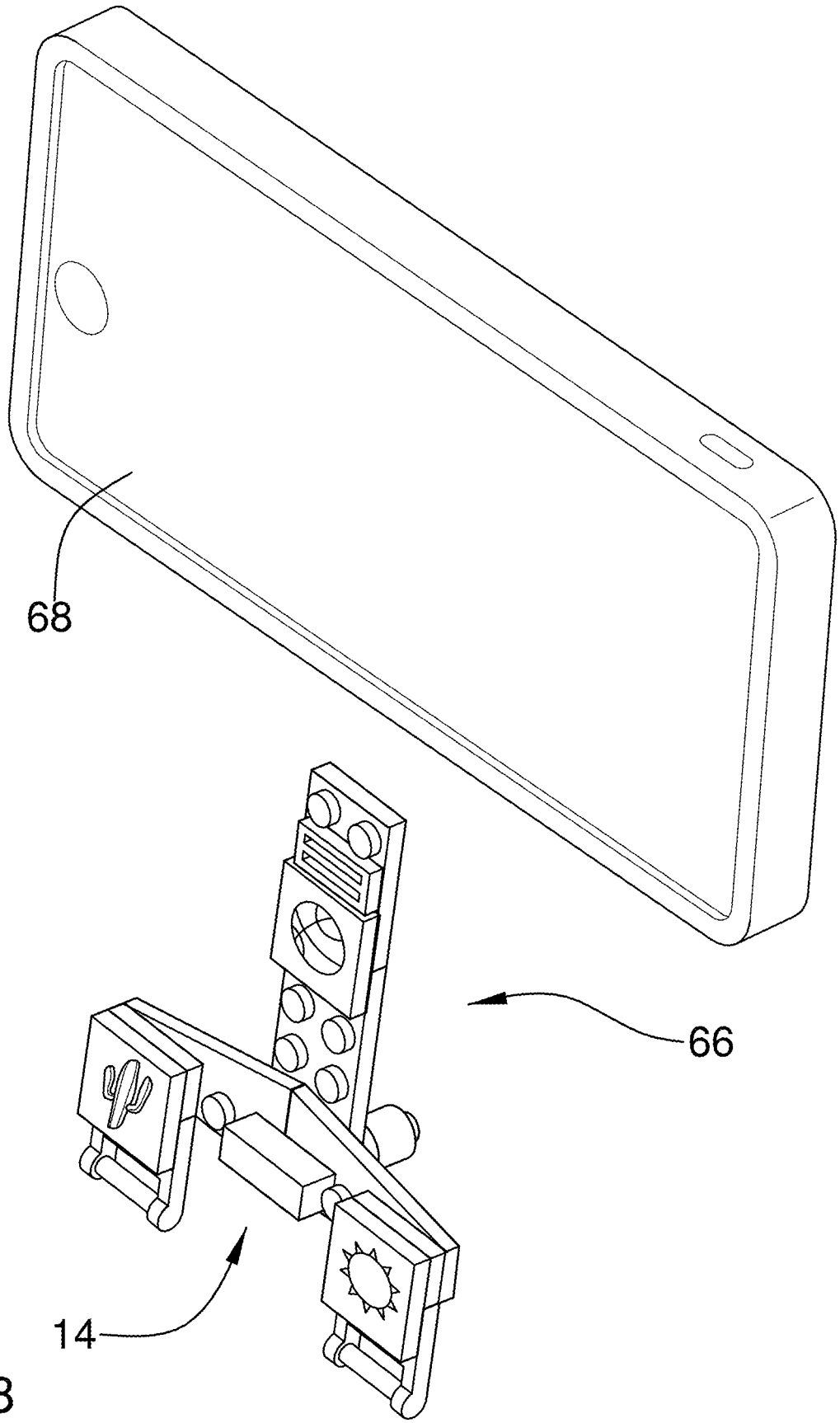
FIG. 8 is a perspective view of an embodiment of the disclosure in use.

FIGS. 7 and 8 show only two possible examples of a near limitless number of possible devices that could be constructed from the mini-brick accessories 14, which can be removed without needing to remove the mini-bricks 12 from the shoes 62. For example, a sports-themed kit could form a mini-basketball court with a small basketball hoop and ball attachment, or possibly a baseball field with miniature bats and balls, that is playable on a table or desk. Other vehicles could be made, such as boats, cars, or spacecraft. Different kits could be used to form Christmas ornaments, necklaces, bracelets or jewelry. Other kits could be collector sets with memorabilia or specially themed components, such as pieces of game worn uniforms, court material, grass or astroturf, and trading cards.

In one possible embodiment, the shoe decoration kit 10 could include a variety of additional components to produce a variety of effects. For example, the shoe decoration kit 10 could include LED lighting capabilities and kinetic energy-powered bricks to generate electricity to power the lights on the shoe 62 or any device requiring batteries, such as, for example, a mini-Bluetooth® speaker or other audio device to play music or sounds. Connectable Bluetooth LED screens could be used to display digital images for brands, logos, family photos, and other images. There could be pen, pencil, and crayon holder attachments. Charms and other decorative items could be attached. Various fabrics and plastic cover materials could be used to customize the mini-bricks 12. Wheels could be included to make vehicles that roll around on a surface. The mini-bricks 12 can primarily be made of plastic, but also could be made of any other type of suitable natural or synthetic material, such as, for example, wood, hemp, metal, alloys, and combinations thereof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A shoe decoration kit comprising:

a plurality of mini-bricks, each of the mini-bricks including a plurality of projections being configured to detachably couple the mini-bricks to receptacle portions of other mini-bricks and mini-brick accessories, each of the mini-bricks including a receptacle portion being configured to detachably couple the mini-bricks to projections of other mini-bricks and mini-brick accessories, the mini-bricks comprising:

at least one mini-brick block, the mini-brick block including a top block wall and a perimeter block wall extending perpendicularly from the top block wall, the mini-brick block including a block passage having a pair of apertures in the perimeter block wall being configured for insertion of a shoelace into and through the mini-brick block parallel to the top block wall to removably secure the mini-brick block to a shoe; and at least one mini-brick panel, the mini-brick panel having a pair of apertures being configured for insertion of a shoelace through opposing ends of the mini-brick panel to removably secure the mini-brick panel to the shoe;

a plurality of mini-brick accessories, each of the mini-brick accessories including a receptacle portion being configured to detachably couple the mini-brick accessories to the projections of the mini-bricks and other mini-brick accessories to removably secure the mini-brick accessories to the shoe, the mini-brick accessories comprising at least one of: tiles, bulbs, chains, plates, and a figurine in the form of a person; and wherein the apertures in the mini-brick panels are formed either in between the projections or in place of one of the projections.

2. The shoe decoration kit of claim 1, further comprising a shoelace.

3. The shoe decoration kit of claim 1, wherein the mini-brick accessories are configured to be assembled into a toy or functional device after detachment from the mini-bricks.

4. The shoe decoration kit of claim 1, wherein the mini-bricks further comprise at least one complete mini-brick without apertures therein, the complete mini-brick includes adhesive to adhere the complete mini-brick to at least one of: the shoelace and the shoe.

5. The shoe decoration kit of claim 1, wherein the mini-brick accessories comprise the figurine in the form of a person.

6. The shoe decoration kit of claim 1, wherein the mini-brick accessories comprise the chain to secure the figurine to one of the mini-bricks or one of the mini-brick accessories.

7. The shoe decoration kit of claim 1, wherein:

the mini-brick accessories comprise at least one of the tiles; and at least one of the tiles includes a decorative image thereon.

8. The shoe decoration kit of claim 1, wherein:

the mini-brick accessories comprise at least one of the bulbs; and the bulbs are hollow for threading the bulbs onto the shoelace or placement on one of the projections of the mini-bricks.

9. The shoe decoration kit of claim 1, wherein:

the mini-brick accessories comprise the plates; and the plates are at least one of square, rectangular, triangular, and trapezoidal in shape.

10. The shoe decoration kit of claim 2, wherein the mini-brick accessories are configured to be assembled into a toy or functional device after detachment from the mini-bricks.

11. The shoe decoration kit of claim 10, wherein the mini-bricks further comprise at least one complete mini-brick without apertures therein, the complete mini-brick includes adhesive to adhere the complete mini-brick to at least one of: the shoelace and the shoe.

12. The shoe decoration kit of claim 11, wherein the mini-brick accessories comprise the figurine in the form of a person.

13. The shoe decoration kit of claim 12, wherein the mini-brick accessories comprise the chain to secure the figurine to one of the mini-bricks or one of the mini-brick accessories.

14. The shoe decoration kit of claim 13, wherein:

the mini-brick accessories comprise at least one of the tiles; and at least one of the tiles includes a decorative image thereon.

15. The shoe decoration kit of claim 14, wherein:

the mini-brick accessories comprise at least one of the bulbs; and the bulbs are hollow for threading the bulbs onto the shoelace or placement on one of the projections of the mini-bricks.

16. The shoe decoration kit of claim 15, wherein:

the mini-brick accessories comprise the plates; and the plates are at least one of square, circular, rectangular, triangular, and trapezoidal in shape.

* * * * *